US010994907B2

(12) United States Patent
Tschida et al.

(10) Patent No.: US 10,994,907 B2
(45) Date of Patent: May 4, 2021

(54) CABLE TIE HAVING A WEDGE LOCKING MECHANISM

(71) Applicant: ABB Schweiz AG, Baden (CH)

(72) Inventors: Colin E. Tschida, Durham, NC (US); Kathryn F. Murphy, South San Francisco, CA (US); James Baker, Southaven, MS (US); Yan Gao, Bothell, WA (US); Andrew Cole, Southhaven, MS (US); Phillip J. Taylor, Jr., Germantown, TN (US)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/049,070

(22) Filed: Jul. 30, 2018

(65) Prior Publication Data

US 2019/0031413 A1 Jan. 31, 2019

Related U.S. Application Data

(60) Provisional application No. 62/539,516, filed on Jul. 31, 2017.

(51) Int. Cl.
*B65D 63/10* (2006.01)
*B65D 63/14* (2006.01)

(52) U.S. Cl.
CPC ..... *B65D 63/1036* (2013.01); *B65D 63/1063* (2013.01); *B65D 63/1072* (2013.01); *B65D 63/14* (2013.01); *B65D 2563/103* (2013.01); *B65D 2563/107* (2013.01)

(58) Field of Classification Search
CPC ..... B65D 63/1036; B65D 63/1072; B65D 63/14; B65D 63/1063; B65D 2563/103; B65D 2563/107; B65D 63/1027; B65D 63/107; Y10T 24/1498; Y10T 24/141; F16B 2/08
See application file for complete search history.

(56) References Cited

U.S. PATENT DOCUMENTS 134,052 A * 12/1872 Gurley ..... F16L 3/233 24/25
3,149,808 A 9/1964 Weckesser
3,300,825 A 1/1967 Andreasen
3,537,146 A 11/1970 Caveney
3,584,525 A 6/1971 Caveney et al.
3,654,669 A 4/1972 Fulton
3,766,610 A 10/1973 Thorsbakken
3,875,618 A * 4/1975 Schuplin ..... B65D 63/16 24/16 PB
3,900,922 A 8/1975 McCormick
3,909,884 A 10/1975 Weckesser
4,557,023 A * 12/1985 Six ..... B65D 63/1072 24/16 PB
4,688,302 A 8/1987 Caveney
4,761,861 A * 8/1988 Peles ..... A44B 11/10 24/196

(Continued)

*Primary Examiner* — Robert Sandy
*Assistant Examiner* — Rowland Do
(74) *Attorney, Agent, or Firm* — Taft Stettinius & Hollister LLP

(57) ABSTRACT

A cable tie is provided with a wedge disposed within a passage extending through a head. The wedge is compressed within the passage when tension is applied to the strap. As a result, the wedge compresses the strap against an inner surface of the passage to restrain the strap.

20 Claims, 2 Drawing Sheets

(56) References Cited

U.S. PATENT DOCUMENTS

| | | | | | |
|---|---|---|---|---|---|
| 4,862,560 | A * | 9/1989 | Lichtenberg | B65D 63/16 | 24/16 PB |
| 4,993,669 | A * | 2/1991 | Dyer | B65D 63/16 | 24/16 PB |
| 5,304,188 | A * | 4/1994 | Marogil | A61B 17/12009 | 24/16 PB |
| 5,386,615 | A * | 2/1995 | Bernard | B65D 63/14 | 24/16 PB |
| 5,544,391 | A * | 8/1996 | Hoffman | B65D 63/14 | 24/16 PB |
| 5,653,409 | A * | 8/1997 | White, Jr. | F16L 3/137 | 248/73 |
| 6,128,809 | A * | 10/2000 | Khokhar | F16L 3/2338 | 24/136 R |
| 6,230,369 | B1 * | 5/2001 | Steadman | F16L 3/233 | 24/16 PB |
| 9,334,091 | B2 | 5/2016 | Zantout et al. | | |
| 2001/0025399 | A1 * | 10/2001 | Rohaly | F16L 3/2338 | 24/30.5 R |
| 2010/0306967 | A1 * | 12/2010 | Geiger | B65D 63/14 | 24/16 PB |
| 2011/0162171 | A1 * | 7/2011 | Gmeilbauer | F16B 2/08 | 24/16 R |
| 2013/0205545 | A1 * | 8/2013 | Zantout | B65D 63/00 | 24/16 R |
| 2018/0229906 | A1 * | 8/2018 | Bednarowski | B29C 48/345 | |

* cited by examiner

CABLE TIE HAVING A WEDGE LOCKING MECHANISM

FIELD OF INVENTION

The present application is directed to a cable tie for securing materials including but not limited to a plurality of wires or cables without cutting the cable tie strap during such securement.

BACKGROUND

Cable ties having a strap, a head and a securement mechanism within the head are designed for strength across a range of industrial applications for the bundling or securement of objects. Certain applications require that the strap is prevented from being cut by the securement mechanism such as a barb when the strap is engaged with the head of the cable tie. While cable ties have been provided that do not sever the strap, they may pierce or otherwise compromise the strength of the strap.

SUMMARY

A cable tie is described for locking a strap within a passage of a head. A wedge is provided within the passage to compress the strap against an inner surface of the passage. When tension is applied to the strap, the wedge is compressed within the passage to grip the strap and prevent the strap from slipping out of the passage.

BRIEF DESCRIPTION OF THE DRAWINGS

In the accompanying drawings, structural embodiments are illustrated that, together with the detailed description provided below, describe exemplary embodiments of a cable tie having a wedge as a locking mechanism. One of ordinary skill in the art will appreciate that a component may be designed as multiple components or that multiple components may be designed as a single component.

Further, in the accompanying drawings and description that follow, like parts are indicated throughout the drawings and written description with the same reference numerals, respectively. The figures are not drawn to scale and the proportions of certain parts have been exaggerated for convenience of illustration.

DETAILED DESCRIPTION

Figure 1:
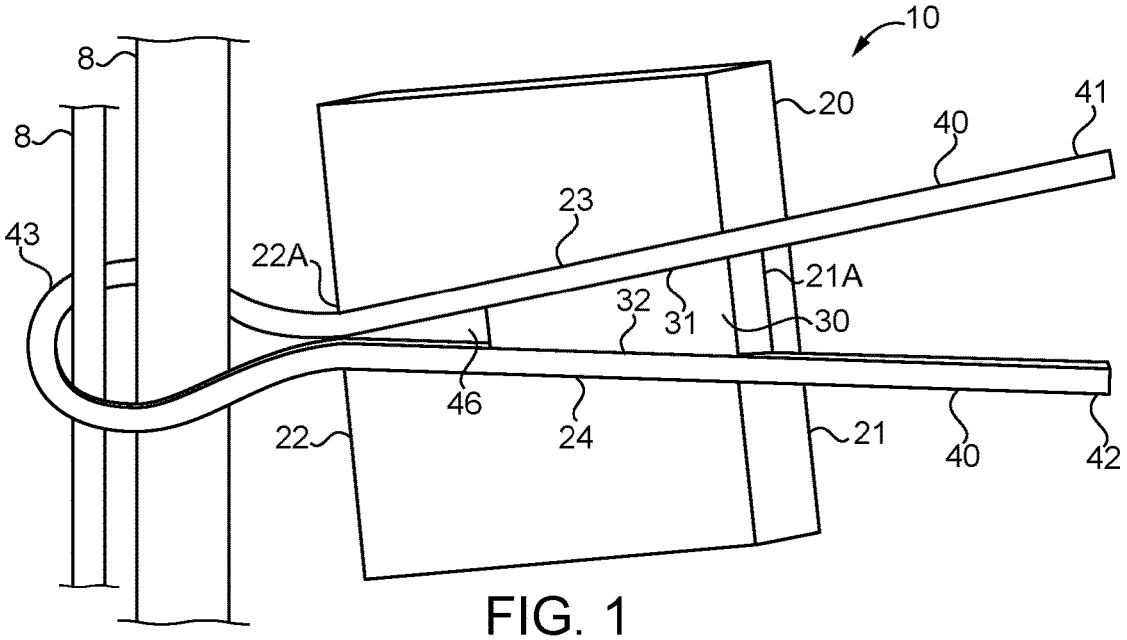
FIG. 1 is a side sectional view of a cable tie having a wedge for retaining a strap in a locking head of the cable tie.

With reference to FIG. 1, a cable tie 10 is shown having a wedge 30 for locking a strap 40 in place within a head 20 of the cable tie 10. The strap 40 is elongated and has a planar surface. The strap 40 has opposing ends 41, 42 that are secured to form a loop 43 around at least one object for securement and/or bundling of the at least one object with the opposing ends 41, 42 secured between the wedge 30 and the respective opposing inner surfaces 23, 24 of the head 20.

The head 20 of the cable tie 10 has beveled inside surfaces 23, 24 that are angled to form a larger opening 21A at a first end 21 than the opening 22A at a second end 22 of the head 20. The beveled head 20 inner surfaces 23, 24 accommodate the shape of opposing contact surfaces 31, 32 of the wedge 30 and provide a friction fit when engaging the strap 40. The inner surfaces of the head 20 also include opposing side walls which may not be in engagement with the wedge 30 when the strap 40 is secured The head 20 and wedge 30 are formed of a plastic such as a thermoset or a thermoplastic material, fiber reinforced plastic or a metal material. Examples of fibers for reinforcing a plastic material include but are not limited to glass fiber, carbon fiber, p-phenylene terephthalamide fiber, such as is sold under the tradename, Kevlar, and boron fiber. The strap 40 is formed of a plastic material such as a thermoset or thermoplastic material, a fiber reinforced plastic, or a metal material. In one embodiment, the wedge 30 is formed entirely of an elastomeric material or has opposing contact surfaces 31, 32 coated by the elastomeric material. In one embodiment, the strap 40 is formed of an acetal material.

Figure 2:
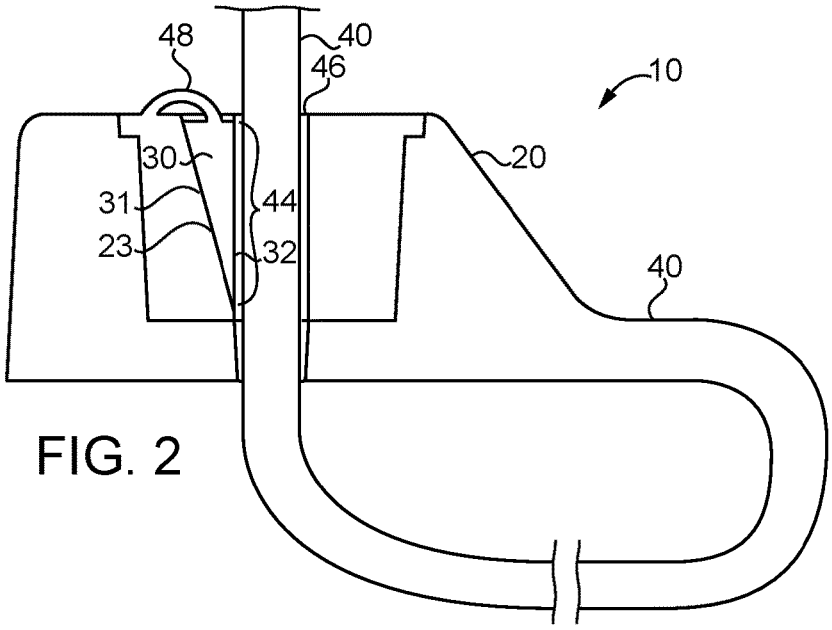
FIG. 2 is a perspective view of the cable tie having a wedge integral to the strap.
Figure 3:
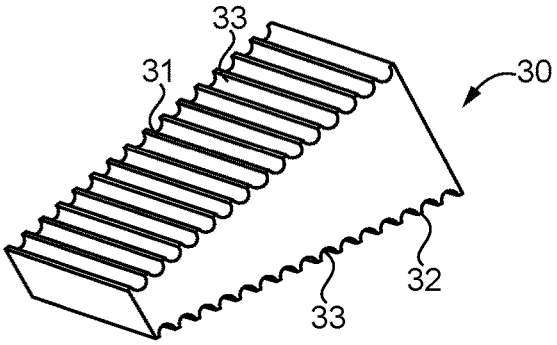
FIG. 3 is a perspective view of the wedge.

The wedge 30 is a separate component as is shown in FIGS. 1 and 3. With reference to FIG. 2, one embodiment of the wedge 30 is shown integrally formed with the strap 40 and together provided as a single component. In that same embodiment, the wedge 30 is integral to a planar portion 44 of the strap 40. When the wedge 30 is integral to the strap, the wedge 30 may be located near one of the opposing ends of the strap 40.

The wedge 30, when integrated with the strap 40, has the wedge 30 contact surface 31 fused to the strap 40. In that same embodiment, the wedge 30 contact surface 32 is planar or has a textured surface 32 for providing a friction engagement with the corresponding strap 40 opposing end. The textured surface 32 includes but is not limited to a serrated, bumpy, ribbed, knurled, or stippled surface. Texture may also be applied to the strap portion that interfaces with the wedge 30 textured surface 32 to increase mutual friction.

Alternatively, in FIGS. 1 and 2, and may be desirable for the wedge 30 to be separate from the strap 40 and loosely fitted within the passage 46 in the head 20. As shown in FIG. 2, it may also be desirable for the wedge 30 to be restrained in the passage 46 with a connector 48 that attaches the wedge 30 to the head 20. The connector 48 may be a thin molded portion of the head 20 that allows the wedge 30 to move within the passage 46 while restraining the wedge 30 in the passage 46. As shown in FIG. 2, it may also be desirable for the strap 40 to be integral with the head 20. By contrast, in FIG. 1 the strap 40 is preferably non-integral with the head 20. That is, the strap 40 may be provided on a reel that holds a long length of strap material sufficient to provide numerous cut-to-length straps 40. Although the wedge 30 in FIG. 1 may be restrained in the passage 46 with a connector 48 like in FIG. 2 or with a cover, it may also be desirable for the wedge 30 to be unrestrained from the passage 46 so that the strap 40 can be freely threaded through the passage 46 without the presence of wedge 30, and thereafter the wedge 30 can be pressed into the passage 46 between the ends of the strap 40.

The wedge 30, strap 40, and head 20 may all be formed together in one mold, such as through injection molding and each part may be separated after the injection molding process is completed. In such an injection molding process, the strap 40 and wedge 30 may be formed as a single component or separate components, and the head 20 may have the wedge 30 molded therein, however, separable in a manner similar to a blister pack. When the head 20 has the wedge 30 molded therein, the components are separated for use following the molding process.

Alternatively, the wedge 30, strap 40, and head 20 are formed using additive manufacturing or any other suitable technique. In such manufacturing processes, the wedge 30 and strap 40 are provided as separate pieces or integrally formed together. The head 20 may be formed in the same process as the wedge 30 and strap 40 but remains as a separate component. When the wedge 30 and/or head 20 are formed of a metal, the material is subject to a machining and/or cutting process.

With reference to FIG. 3, the wedge 30 has textured surfaces 33 on opposing contact surfaces 31, 32 thereof. The textured surfaces 33 increase the friction between the wedge 30, the strap 40 and the inside surfaces 23, 24 of the head 20, to hold the strap 40 in place after the at least one object is secured. In one embodiment, the textures are of a shallow depth when compared to a flat, planar surface. It should be understood that the wedge 30 may alternatively be provided with planar, contact surfaces 31, 32 that are free from textured surfaces 33.

Figure 6:
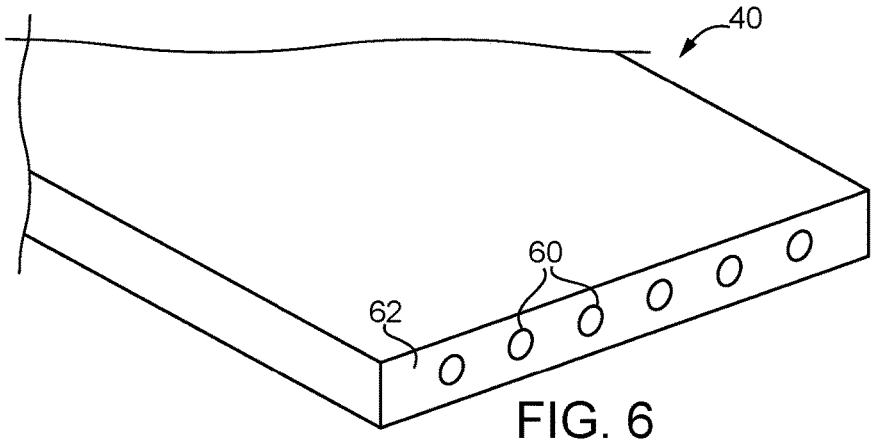
FIG. 6 is a perspective cross-sectional view of the strap.

Alternatively, where the strap 40 is non-integral with the head 20 and provided as a long length of strap material for cut-to-length straps 40 on a reel, it may be particularly desirable to make the strap 40 by an extrusion process. Unlike conventional molded tie straps that have lateral ridges on the outer surfaces thereof to grip against a pawl in the head 20, an extruded strap 40 will typically have a longitudinally smooth outer surface without laterally oriented features. This can make it more difficult to solidly grip the strap 40 to prevent slipping of the strap 40 through the head 20 when tension is applied. Although more aggressive teeth in the head 20 may be used in such an arrangement to grip the strap 40, this may cause other undesirable problems. For example, as shown in FIG. 6, it may be desirable to provide the extruded strap 40 with continuous fibers 60 that are co-extruded with a polymer 62. In such an arrangement, the polymer 62 forms the extruded body of the strap 40 and the fibers 60 are embedded therein and extend along the entire length of the strap 40. As a result, the fibers 60 provide the strap 40 with significantly greater tensional strength. However, as noted, an extruded strap 40 will typically have a smooth longitudinal surface that is more difficult to grip, and more aggressive teeth may be undesirable since the teeth could bite into the strap 40 and fracture or cut the fibers 60. This could be a particular problem where the fibers 60 are glass fibers or other non-metal fibers. Thus, in this arrangement, the wedge 30 shown in FIGS. 1-3 may be particularly advantageous since the wedge 30 evenly contacts the strap 40 along the entire length where the wedge 30 compresses against the strap 40. For example, in the wedge 30 of FIGS. 1-3, the thickness of the wedge 30 between the side surfaces 31, 32 increases linearly along the length thereof. Therefore, unlike conventional pawl arrangements where one end of the pawl digs into the strap 40 more than the opposite end, in the wedge 30 of FIGS. 1-3 the compression force is balanced along the entire contact length between the wedge 30 and the strap 40. Thus, in this arrangement, the textured surface 33 of the wedge 30 does not provide the primary gripping strength to hold the strap 40. Instead, the textured surface 33 only provides an initial restraint to hold the strap 40, wedge 30 and head 20 together. The primary gripping strength is produced as tension is applied to the strap 40 and the wedge 30 is pulled into the passage 46, which causes the wedge 30 to be compressed in the passage 46 between the inner surfaces 23, 24 thereof. As a result, the strap 40 is compressed against one of the inner surfaces 23, 24 of the passage 46 by one of the side surfaces 31, 32 of the wedge 30.

Figure 4:
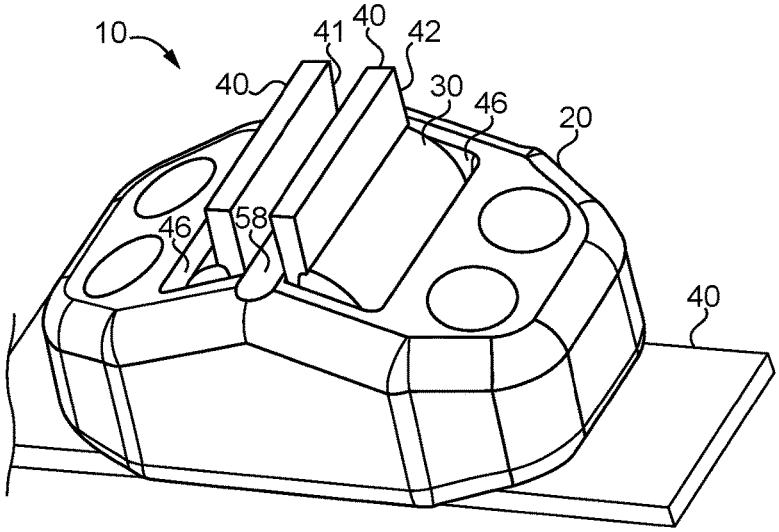
FIG. 4 is a perspective view of another embodiment of the cable tie.
Figure 5:
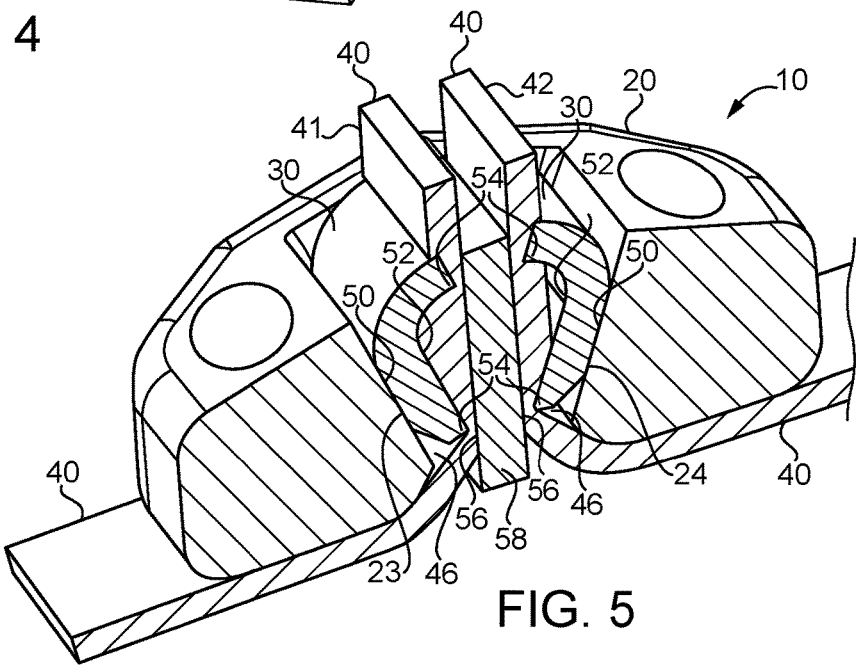
FIG. 5 is a perspective cross-sectional view of the embodiment of FIG. 4.

Another embodiment of the cable tie 10 is shown in FIGS. 4-5. This embodiment may be desirable where the strap 40 is extruded as described above with co-extruded continuous fibers 60, but where the fibers 60 are metallic fibers. Preferably, the continuous metal fibers 60 are wound about each other to form wire ropes extending the length of the strap 40. In this case, it may be desirable for the wedge 30 to dig into the strap 40 and deform the metal fibers 60 in order to grip the strap 40. Preferably, the wedge 30 penetrates the polymer body 62 of the strap 40 and contacts the metal fibers 60 embedded therein to deform the metal fibers 60. As such, the metal fibers 60 and wedges 30 are preferably made of metals resistant to corrosion, and particularly are preferably made of metals resistant to galvanic corrosion since the wedge 30 and metallic fibers 60 may come into contact with each other. Thus, in a preferred embodiment, the metal fibers 60 and wedges 30 are both made of the same metal, such as stainless steel.

As shown in FIG. 5, each of the wedges 30 have a flat surface 50 contacting a beveled inner surface 23, 24 of a passage 46 extending through the head 20. The opposing side surface 52 has at least two edges 54 that bite into the strap 40. For example, the edges 54 may be two opposing ends of the wedge 30 that are angled toward the strap 40 to form sharp edges 54. Unlike the embodiments of FIGS. 1-3, the wedge 30 need not have an increasing thickness. However, like the embodiments of FIGS. 1-3, the wedge 30 is compressed between the inner surfaces 23, 24, 56 of the passage 46, and the strap 40 is compressed between one of the inner surfaces 56 of the passage 46 and a side surface 52 of the wedge 30 (e.g., the two sharp edges 54). As shown, the head 20 may be provided with two passages 46, with one end of the strap 40 extending through each passage 46 and one wedge 30 being disposed in each passage 46 to compress the respective end of the strap 40. The two passages 46 may be formed by a web 58 of the head 20 that separates the passages 46 and forms a non-beveled inner surface 56 of each passage 46. Each passage 46 may also have a beveled inner surface 23, 24 located on an opposite side from the web 58. Thus, as shown the strap 40 contacts the non-beveled surface 56 of the web 58, and the wedge 30 contacts the beveled surface 23, 24 on the opposite side of the passage 46.

The strap 40 is secured in the head by placing one of the strap opposing ends 41, 42 between a respective inner surface of the head 20 and the corresponding opposing contact surface of the wedge 30, securing the at least one object 8 in the loop 43 and placing the other one of the strap opposing ends 41, 42 between the opposing inner surface of the head 20 and opposing textured surface 33 of the wedge 30. The opposing ends 41, 42 are urged along with the wedge 30 inside the head 20 until no further movement is possible of the wedge 30 and the strap 40 opposing ends 41, 42 within the head 20 in a direction toward the at least one object 8. In this manner, the wedge 30 is immobilized within the head 20 in a friction fit with the strap 40. When the strap 40 is urged in the opposite direction, the strap 40 and wedge 30, are released from the head 20.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application illustrates various embodiments, and while these embodiments have been described in some detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative embodiments, and illustrative examples shown and described. Accordingly, departures may be made from such details without departing from the spirit or scope of the applicant's general inventive concept.

The invention claimed is:

1. A cable tie for securing at least one object, comprising:

an elongated strap having a planar surface and opposing ends;

a head having a first end and a second end and beveled opposing inner surfaces extending between the first and second ends to form corresponding first and second end openings, and wherein the first end opening is larger than the second end opening;

a wedge having opposing side surfaces for engaging respective opposing ends of the elongated strap in a friction fit within the head; and wherein when the wedge is engaged with the elongated strap and the head, the strap is immobilized within the head when urged in a direction toward the at least one object;

wherein both of the opposing ends of the elongated strap extend out from the first end of the head and a loop being formed by the elongated strap adjacent the second end of the head;

wherein the strap is released when the opposing ends are urged in a direction opposite to the at least one object;

wherein the wedge is separate and unrestrained from the head and strap such that the strap is freely threadable through the first and second openings in the head without the presence of the wedge and the wedge thereafter being pressed into the head.

2. The cable tie of claim 1, wherein the wedge opposing contact surfaces are textured surfaces.

3. The cable tie of claim 2, wherein a textured portion of the strap is in contact with the wedge textured surfaces.

4. The cable tie of claim 1, wherein the wedge opposing contact surfaces are planar.

5. The cable tie of claim 1, wherein the wedge is formed of a metal.

6. The cable tie of claim 1, wherein the wedge is formed of one of a thermoplastic and a thermoset material.

7. The cable tie of claim 1, wherein the wedge is formed of an elastomeric material.

8. A cable tie for securing at least one object, comprising:

an elongated strap having opposing ends;

a head having two passages extending therethrough with a web of the head separating the two passages from each other, each of the passages comprising a first inner surface and a second inner surface, the second inner surface of each passage being defined by the web;

two wedges each having opposing side surfaces;

wherein one of the wedges is disposed within one of the passages and another of the wedges is disposed within another of the passages, each of the wedges being compressed between the first and second inner surfaces of the respective passage; and wherein the elongated strap is disposed within each of the passages and is compressed between one of the first and second inner surfaces of the respective passage and one of the side surfaces of the respective wedge;

wherein both of the opposing ends of the elongated strap extend out from one end of the head with one of the opposing ends extending out from one of the passages and the other opposing end extending out from the other of the passages, and a loop being formed by the elongated strap adjacent an opposite end of the head;

wherein the wedges are separate and unrestrained from the head and elongated strap such that the elongated strap is freely threadable through the passages in the head without the presence of the wedges and the wedges thereafter being pressed into the passages.

9. The cable tie of claim 8, wherein the elongated strap has longitudinally smooth outer surfaces formed by extrusion.

10. The cable tie of claim 8, wherein the elongated strap is non-integral with the head.

11. The cable tie of claim 8, wherein the elongated strap comprises continuous fibers extending an entire length of the elongated strap.

12. The cable tie of claim 11, wherein the elongated strap is formed by coextruding a polymer and the continuous fibers.

13. The cable tie of claim 8, wherein the one surface of each of the wedges compressing against the elongated strap evenly contacts the elongated strap along an entire length of the one surface.

14. The cable tie of claim 8, wherein the side surfaces of each of the wedges define an increasing thickness therebetween along a length of each of the wedges.

15. The cable tie of claim 14, wherein the thickness of each of the wedges increases linearly.

16. The cable tie of claim 8, wherein the one surface of each of the wedges compressing against the elongated strap comprises an edge penetrating the elongated strap.

17. The cable tie of claim 16, wherein the elongated strap comprises continuous metal fibers extending an entire length of the elongated strap, the elongated strap being formed by coextruding a polymer and the continuous metal fibers, and each of the wedges comprising two of the edge deforming the continuous metal fibers.

18. The cable tie of claim 8, wherein one of the first and second inner surfaces of each of the passages is beveled, the beveled inner surface being disposed on an opposite side of the respective wedge from the elongated strap.

19. The cable tie of claim 18, wherein the first inner surface of each of the passages is beveled and the second inner surface of each of the passages is non-beveled.

20. The cable tie of claim 8, wherein the elongated strap is compressed between the second inner surface of each respective passage and the respective wedge, and each of the wedges contact the first inner surface of each respective passage.

* * * * *